US005518224A

United States Patent [19]

Anderson

[11] Patent Number: 5,518,224

[45] Date of Patent: May 21, 1996

[54] MOTORCYCLE LIFT STAND

[76] Inventor: Kenneth C. Anderson, 597 Furnace Rd., Conneaut, Ohio 44030

[21] Appl. No.: 297,491

[22] Filed: Aug. 29, 1994

Related U.S. Application Data

[63] Continuation-in-part of Ser. No. 82,783, Jun. 28, 1993, abandoned.

[51] Int. Cl.[6] ..... B66F 3/00

[52] U.S. Cl. ..... 254/131

[58] Field of Search ..... 254/8 R, 8 B, 254/8 C, 10 R, 10 B, 10 C, 131, 120

[56] References Cited

U.S. PATENT DOCUMENTS

| | | | |
|---|---|---|---|
| 255,818 | 4/1882 | Rogers | 254/10 C |
| 1,958,292 | 5/1934 | Barrett | 254/10 C |
| 3,306,579 | 2/1967 | Campbell | 254/10 R |
| 4,113,235 | 9/1978 | Hartman | 254/131 |

*Primary Examiner*—Robert C. Watson
*Attorney, Agent, or Firm*—James H. Tilberry

[57] ABSTRACT

A foot-operated motorcycle lift stand. The cyclist drives the motorcycle over the lift stand in its lowermost compact position. While manually steadying the motorcyle, the cyclist actuates a foot lever to shift the stand platform into lifting engagement with the undercarriage of the motorcycle by means of legs which pivotally secure the platform to a base and which, in motion, describe a parallelogram. The foot lever pivots from its position adjacent one of the legs of the stand to an upstanding position, where additional foot pressure creates a turning moment to shift the legs and platform to a stable raised position. The cyclist's hands are then free to secure the lift stand with positive locking means which lock the stand in place. When not in use, the lift stand can be conveniently stored in an upright position whereby edges of the platform and base provide stable resting means.

23 Claims, 5 Drawing Sheets

MOTORCYCLE LIFT STAND

This application is a continuation-in-part of application Ser. No. 08/082,783, filed Jun. 28, 1993, now abandoned.

BACKGROUND OF THE INVENTION

1. Field of the Invention

The field of invention relates to motorcycle lift stands, and, in particular, to lift stands for off-road motorbikes.

2. Description of Related Art

There are generally two types of motorcycles. The first type of motorcycle is primarily designed for use on improved highways, wherein the motorcycle wheels are normally intended to be in contact with the road at all times. This type of motorcycle is commonly equipped with a so-called "kickstand" for parking the motorcycle in an upright position. The kickstand essentially comprises a spring-loaded rod permanently secured to the chasis of the motorcycle. When the motorcycle is underway, the kickstand is normally carried in a spring-biased horizontal position. When the cyclist wishes to park the motorcycle, pressure of his foot pivots the kickstand downwardly approximately 90° into a second spring-biased position in which the motorcycle is stabilized by leaning against the kickstand.

The second kind of motorcycle, sometimes referred to as a "dirt track bike," is commonly used off highways in cross country competitive events wherein the entire bike may be airborne for short periods, thereafter striking the ground with considerable impact. With this kind of hard use, there is always the danger that a kickstand will become dislodged from its horizontal position upon impact, or that some object on the ground will snag the kickstand, causing injury to the rider and/or to the bike. For this reason, dirt track bikes are not usually equipped with kickstand parking devices.

In lieu of kickstands for dirt track bikes, prior art devices in the form of separate stands have been devised which engage the midsection of the undercarriage of the dirt track bike. These prior art devices include means to extend the stand vertically so as to lift one or both bike wheels from the ground. French Patent No. 1,111,845 to M. Saunois represents this style of prior art lift stand. Saunois essentially comprises a lower rectangular platform pivotally connected to an upper rectangular platform by four legs secured to the four corners of each platform to provide a parallelogram-type connection between the upper and the lower platforms. One leg extends vertically above the upper platform to act as a hand lever to raise and to lower the upper platform. One of the problems associated with this design is that it requires the cyclist to steady the bike with one hand while gripping the lever with the other hand in order to raise the upper platform into lifting engagement with the bike. In addition, the design requires the use of the cyclist's weaker back and arm muscles. Applicant's invention, on the other hand, enables the cyclist to steady the bike with both hands while raising a platform with a novel foot-operable lever, using the stronger, more efficient muscles of the leg.

SUMMARY OF THE INVENTION

Applicant's invention comprises a dirt bike lift stand including a bike-engaging and lifting rectangular platform secured to a base by four legs pivotally secured between the platform and the base, adapted to permit the platform to move in a parallel mode from the lowermost compact position, adjacent and parallel to the base, to an uppermost parallel position in lifting engagement with the undercarriage of a bike. A platform-lifting, foot-operated, lever is pivotally secured to one of the platform legs and folds along the leg when the stand is in the lowermost stored position in the manner of a collapsed parallelogram. Foot pressure on the pivoted end of the foot lever causes the lever to pivot into a substantially vertical position abutting and at substantially right angles with the platform leg. When the cyclist applies foot pressure against the opposite, or free, end of the foot lever, the lever applies a turning moment to the platform leg to which it is attached, which, in turn, pivots it and the other three legs upwardly in a parallelogram motion to raise the platform substantially to its highest elevation. Since the inventive lift stand is designed for hands-free operation, it is important that the foot lever not fall back from the vertical position to which it has been initially rotated. To avoid such inadvertence, the location of the center of gravity of the foot lever, when upright, is such that the weight of the lever will urge the lever into continued abutment with the leg to which it is pivotally attached.

It is also important that the platform not collapse back to its original, lowest, position when the cyclist shifts the platform to its raised position. Accordingly, in the raised position, the platform will be shifted slightly past top dead center, where appropriate stop means bring it to rest. Thus, urging the weight of the platform and legs, by force of gravity, against the stop means temporarily stabilizes the stand until the stop means can be positively secured. Inasmuch as the platform legs shift past vertical, the angle between the foot lever and the leg to which it is attached must compensate for the inclination of the legs beyond the vertical so that the foot lever will not prevent complete shifting of the platform beyond top dead center. In the preferred embodiment of the invention, the angle between foot lever and the leg to which it is attached is substantially 84°.

OBJECTS OF THE INVENTION

It is therefore among the objects of the invention to provide a novel motorcycle lift stand that is safe, rugged, lightweight, and compactable, for easy storage and transportation.

It is another object of the invention to provide a motorcycle lift stand which is operated by a foot lever, so that it does not depend upon lift means such as hydraulic jacks, mechanical screw jacks, electric drive lifts, or ratchet means.

It is still another object of the invention to provide a motorcycle lift stand which, during the lifting procedure, leaves both hands of the cyclist free to maintain motorcycle stability.

It is still another object of the invention to provide a motorcycle lift stand that includes novel trouble-free means for raising a lifting platform into position beneath the center portion of the undercarriage of a motorcycle.

It is yet another object of the invention to provide a motorcycle lift stand which, in its lowermost compact position, is of such low profile as to allow the cyclist to easily position the motorcycle over the device prior to its use.

It is still another object of the invention to provide a motorcycle lift stand which supports a stationary motorcycle in a stable and substantially vertical position at a convenient height such that the cyclist may perform maintenance procedures on the motorcycle.

It is a yet further object of the invention to provide a motorcycle lift stand, the use of which depends almost entirely upon the use of the cyclist's leg muscles, which are stronger and more efficient than arm or back muscles.

BRIEF DESCRIPTION OF THE DRAWINGS

The foregoing and other objects and features of the invention will become apparent from the following description of preferred embodiments of the invention with reference to the accompanying drawings, in which.

DESCRIPTION OF THE PREFERRED EMBODIMENTS OF THE INVENTION

Figure 1:
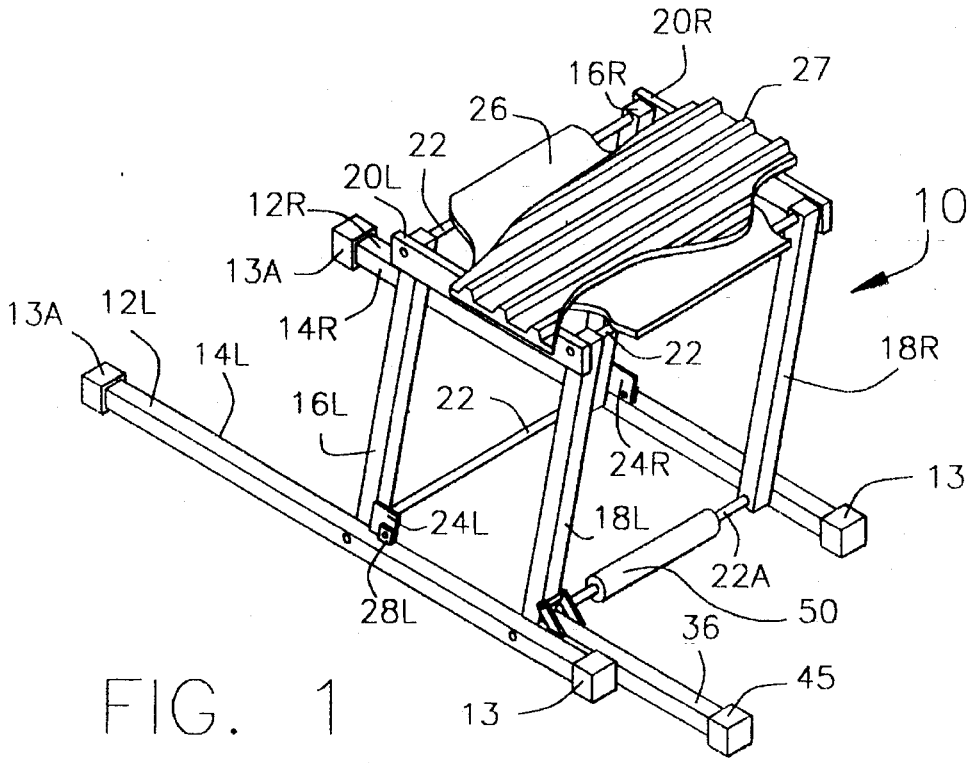
FIG. 1 is a perspective, partially fragmentary, view of a preferred embodiment of the invention shown in the upstanding position.

The preferred embodiment of the inventive lift stand 10 is shown in FIG. 1 to comprise a pair of spaced-apart, parallel base members 12L and 12R, preferably fabricated from 1" square tubular steel stock, approximately 32" in length. Rubber antiskid end caps 13 fit over the opposite ends of base members 12. Pivotally secured to the inside vertical face 14L of base member 12L is a pair of spaced-apart legs 16L and 18L, approximately 18" in length, also fabricated from 1" square tubular steel stock. A matching pair of similar legs 16R and 18R are pivotally secured to the inside vertical face 14R of base member 12R. The upper ends of legs 16L and 18L are pivotally joined by a cross member 20L, which is at all times parallel to base member 12L. In like manner, the upper ends of legs 16R and 18R are pivotally joined by a cross member 20R, parallel to base member 12R. A motorcycle-supporting platform 26 is secured to cross members 20L and 20R. Steel connecting rods 22 pivotally secure the opposite ends of legs 16L and 18L to the corresponding opposite ends of legs 16R and 18R. Legs 16 and 18 are permitted to swing arcuately down and to the left until cross members 20L and 20R make contact with base members 12L and 12R, respectively. Arcuate pivotal movement of legs 16 and 18 to the right is arrested by rectangular stop plates 24L and 24R which are rigidly secured to the lower ends of legs 16L and 16R, respectively, such as by welding. Stop plates 24L and 24R are positioned on legs 16L and 16R so as to make contact with base members 12L and 12R after legs 16 and 18 have been arcuately pivoted just to the right of dead center. So positioned, the weight of the legs and cross members 20L and 20R forces and holds plates 24 into pressure contact with base members 12 by gravitational force.

Figure 2:
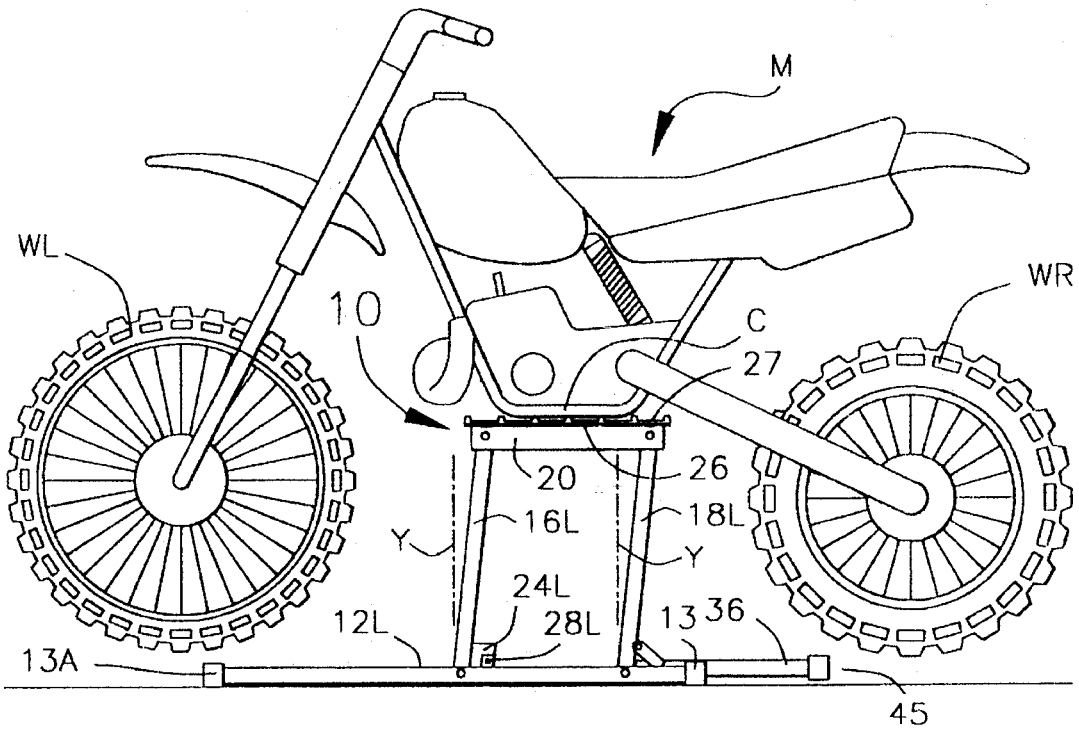
FIG. 2 is a side elevational view of the preferred embodiment of the invention shown in FIG. 1.

As shown in FIG. 2, a transverse ribbed rubber pad 27 secured to the top of the platform 26 engages the underside of a motorcycle chasis C, and, in the full lift position, lifts the motorcycle wheels $W_L$ and $W_R$ free and clear of any other means of support. As will be observed, the legs 16 and 18 are inclined a few degrees to the right, as indicated by vertical axis lines Y, and, in addition to the weight of the lift stand 10, the weight of the motorcycle M also contributes to force plates 24 into pressure contact with base members 12, thereby additionally stabilizing the lift stand 10 against shifting to the left and collapsing. It will be observed that positioning the center of gravity of the motorcycle M more toward the right side of the resting pad 27 further enhances stability of the stand.

Figure 3:
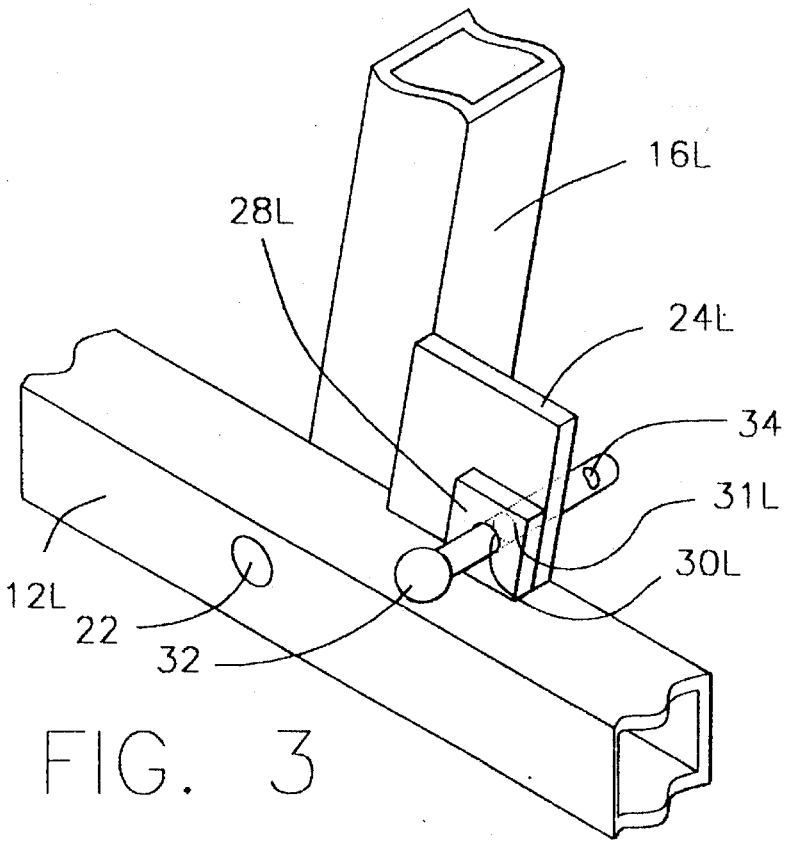
FIG. 3 is an enlarged fragmentary perspective view of a preferred embodiment of the lift stand locking means.

FIG. 3 shows, in enlarged detail, plate 24L permanently secured to leg 16L and an additional plate 28L permanently secured to base 12L, to further assure stability of the lift stand in the standing position shown in FIGS. 1 and 2. Concentric holes 30L and 31L provided in plates 28L and 24L receive a locking pin 32, which can be further secured by inserting a cotter key, not shown, in cotter key hole 34. Thus, plates 24L and 24R positively prevent the lift stand 10 from shifting to the right beyond the position shown in FIGS. 1 and 2, and plates 28L and 28R positively prevent lift stand 10 from shifting to the left when a locking pin 32 is inserted in either concentric holes 30L and 31L or concentric holes 30R and 31R.

Figure 4:
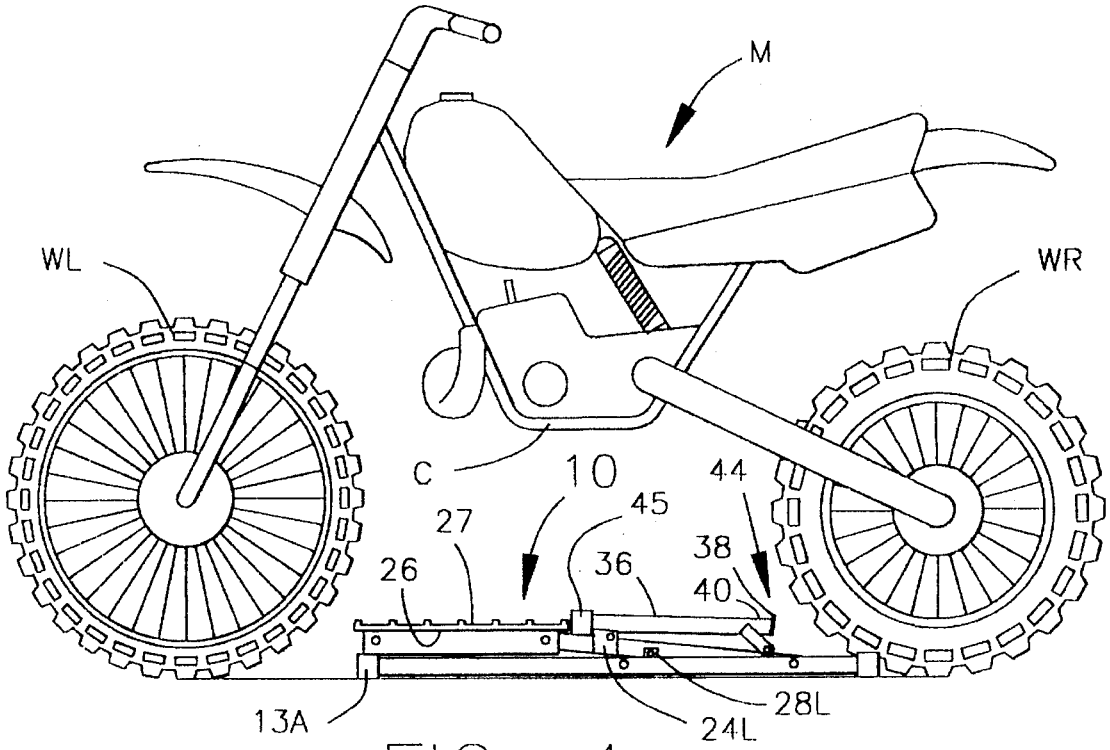
FIG. 4 is a side elevational view of the preferred embodiment of the invention shown in the folded position.
Figure 5:
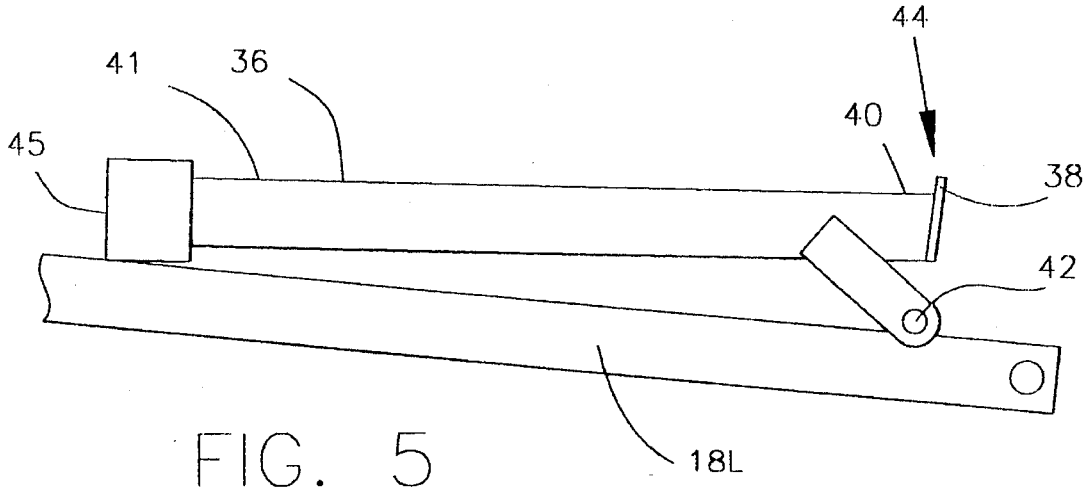
FIG. 5 is an enlarged fragmentary view of the inventive lever means for shifting the inventive lift stand from the folded position to the upstanding position.
Figure 6:
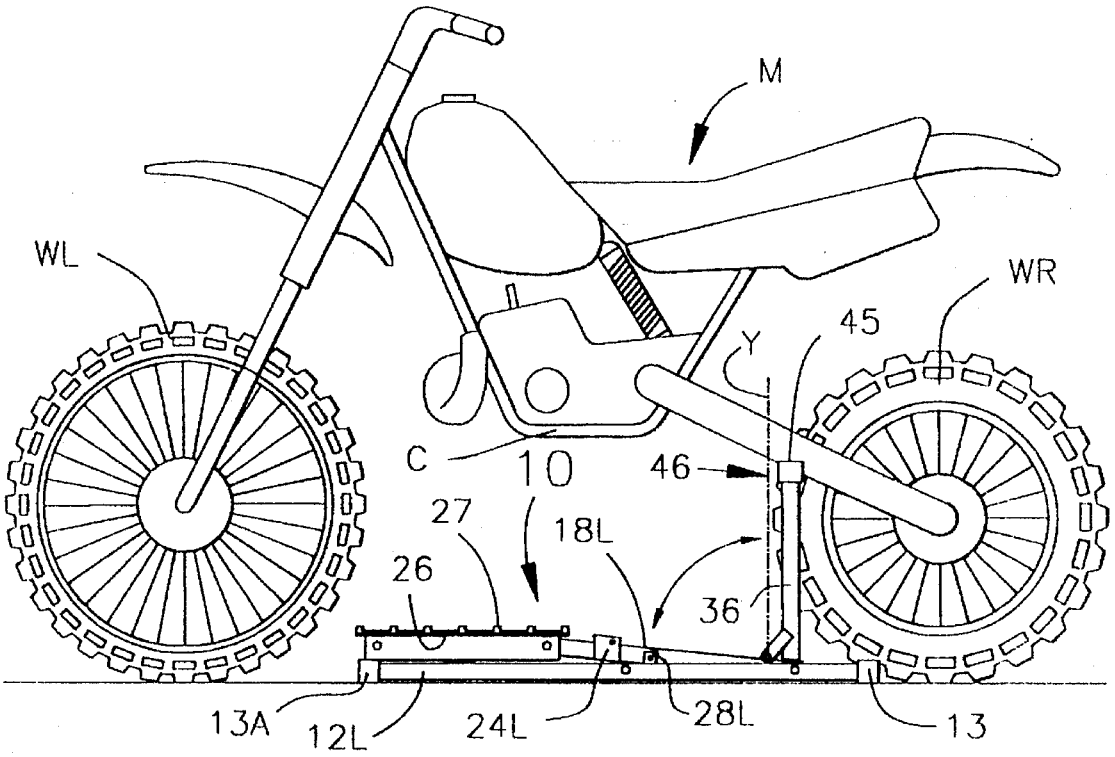
FIG. 6 is a side elevational view of the preferred embodiment of the invention showing the inventive lever means of FIG. 5 in its upstanding position.
Figure 7:
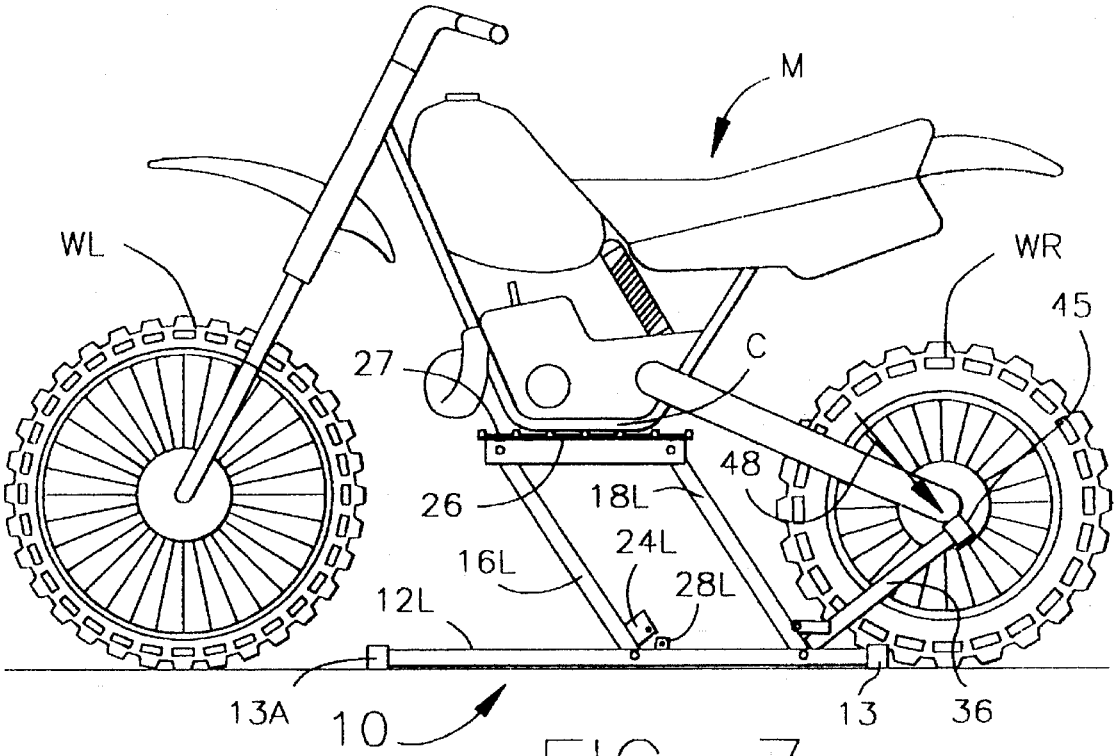
FIG. 7 is a side elevational view of the preferred embodiment of the invention in the partially raised position.

FIG. 4 shows the lift stand 10 in the normal folded position. In this position, it is easy for the cyclist to drive over the lift stand until the front and rear wheels $W_L$ and $W_R$ straddle the stand 10. As better shown in the enlarged fragmentary view FIG. 5, a lift stand lever 36, with a foot cleat 38 on the inboard end 40 and a foot cleat 45 on the outboard end 41, is pivotal about pivot pin 42, rigidly secured to leg 18L, such as by welding. While manually holding the motorcycle M in an upright position over the lift stand 10, the cyclist places his foot on the inboard end 40 of lever 36 and applies downward leg pressure in the direction of arrow 44, which causes lever 36 to rotate in a clockwise direction about pivot pin 42 into the position shown in FIG. 6. As indicated by the vertical Y axis, lever 36 is sufficiently positioned to the right of pivot pin 42 that its center of gravity causes the lever to remain upright, rather than falling back onto the leg 18L. This upright stability of lever 36 enables the cyclist, without removing his hands from the motorcycle M, to shift his foot from inboard foot cleat 38, FIG. 5, to outboard foot cleat 45, FIG. 6, on the outboard end of lever 36 in order to apply lateral leg pressure in the direction of arrow 46. Lever 36 responds to this lateral pressure by arcuately yielding in a clockwise direction to shift the lift stand 10 upwardly in the direction of the undercarriage C of the motorcycle M, as shown in FIG. 7, wherein the motorcycle wheels $W_L$ and $W_R$ begin to leave the ground. Additional leg pressure in the direction of arrow 48 continues to lift the motorcycle M until it is positioned as shown in FIG. 2, a few degrees beyond dead center, with lever 36 fully depressed in a substantially horizontal position. As previously described with respect to FIG. 3, locking pin 32 is next inserted in concentric holes 30L and 31L of stop plate 24L and locking plate 28L. The lift stand 10 is now secured against collapse. Insertion of locking pin 32 is easily accomplished, since the lift stand 10, as designed, is sufficiently stable in the raised position to permit the cyclist to free his hands from the motorcycle for a sufficient period of time to insert locking pin 32 in holes 30L and 31L of plates 24L and 28L.

Figure 3A:
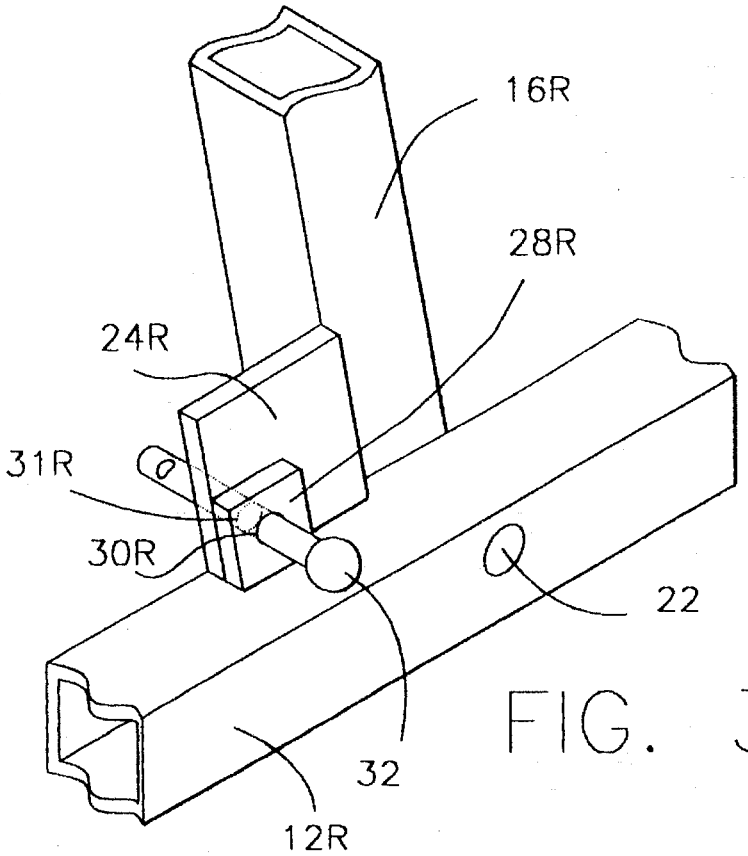
FIG. 3A is an enlarged fragmentary perspective view, similar to FIG. 3, of an alternative preferred embodiment of the lift stand locking means.

If the cyclist prefers to use his left foot to raise lift stand 10, foot lever 36 can be installed on the right side of the lift stand 10 (not shown), in which case, as shown in FIG. 3A, plate 28R would be secured to plate 24R by inserting locking pin 32 in concentric holes 30R and 31R.

To remove the motorcycle M from the lift stand 10, it is merely necessary to remove locking pin 32 from holes 30 and 31 and to give the motorcycle a slight nudge from right to left, as shown in FIG. 2. Once the lift stand 10 is shifted beyond dead center to the left, as shown in FIG. 7, it will fold of its own weight into the compact position shown in FIG. 6, and the momentum of folding will pivot lever 36 into the folded position of FIG. 4. Thereafter the cyclist can start the motorcycle M and drive off, over the top of the folded lift stand 10.

Figure 8:
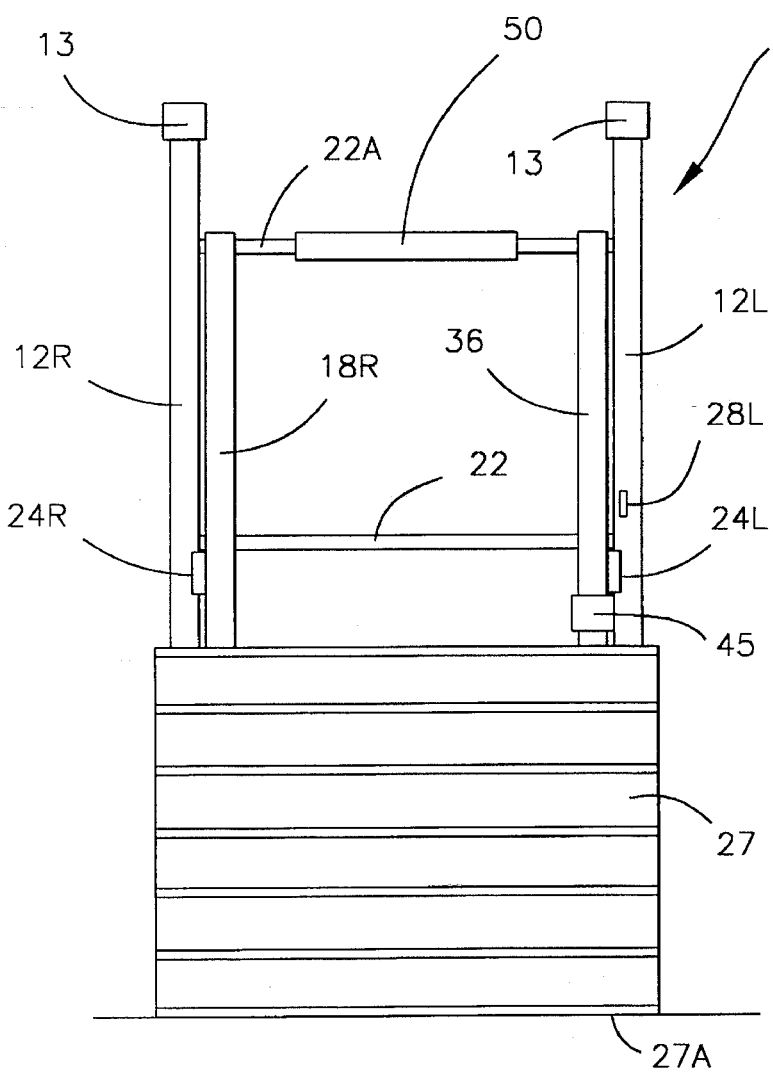
FIG. 8 is a front elevational view of the preferred embodiment of the invention shown in the freestanding storage position.
Figure 9:
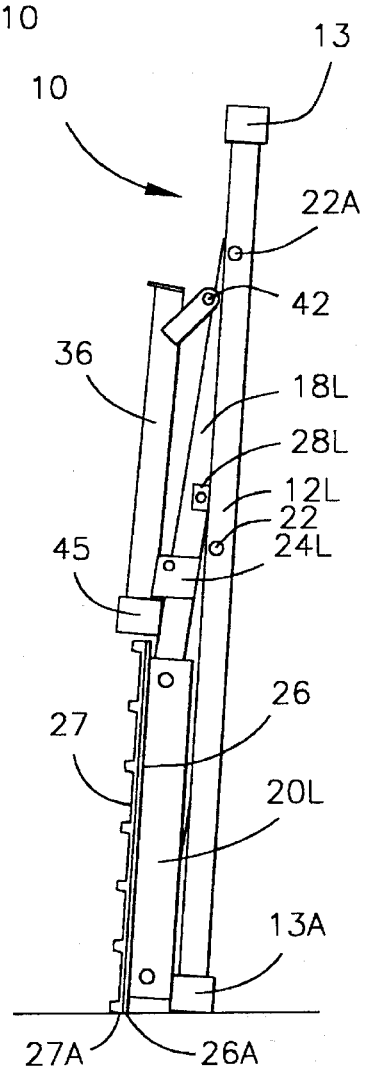
FIG. 9 is a side elevational view of the preferred embodiment of the invention shown in FIG. 8.

After the motorcycle moves from the lift stand, leaving the stand in the folded horizontal position shown in FIG. 4, the stand 10 may be conveniently stored in an upright position requiring minimum storage space. A hand grip 50 encircling rod 22A, FIG. 1, is lifted vertically until the stand 10 rests on end caps 13A, edge 26A of platform 26, and edge 27A of rubber pad 27, FIGS. 8 and 9. As shown in FIG. 9, the width of cross members 20L and 20R horizontally spaces edges 26A and 27A from end caps 13A, to provide a bearing support of sufficient width to enable the stand 10 to be stable in a freestanding position. The location of the pivotal connection 42 between lever 36 and leg 18L enables lever 36 to be aligned and maintained by gravity against leg 18L in a compact folded position, so as not to be an obstruction during storage of the lift stand.

It will occur to those skilled in the art, upon reading the foregoing description of the preferred embodiments of the invention, taken in conjunction with a study of the drawings, that certain modifications may be made to the invention without departing from the intent or scope of the invention. It is intended, therefore, that the invention be construed and limited only by the appended claims.

What is claimed is:

1. In a four-legged parallelogram type motorcycle lift stand having means to raise said lift stand from a substantially horizontal compact mode to a substantially upstanding mode, the improvement comprising a lever having a pivoted end and a free end, pivotally secured to said lift stand, said lever, when said lift stand is in a compact mode, being pivotal from a position folded onto said lift stand to an upright position substantially normal to said lift stand, wherein pressure against said free end of said lever in said upright position and downwardly arcuate away from said lift stand raises said lift stand from a substantially compact mode to a substantially upstanding mode, said pivoted end of said lever including a cantilever extension portion outboard of the position where said lever is pivotally secured to said lift stand, said cantilever extension portion providing a surface for foot pressure to pivot said lever from said folded position to said upright position.

2. The lift stand of claim 1, including a foot cleat secured to said cantilever extension portion of said lever to minimize slippage of foot pressure against said cantilever extension portion of said lever.

3. The lift stand of claim 1, wherein said lever in said upright position forms an angle with said lift stand of slightly less than 90°.

4. The lift stand of claim 1, wherein said lever in said upright position forms an angle with said lift stand of substantially 84°.

5. The lift stand of claim 1, wherein said free end of said lever includes a foot cleat to minimize slippage of foot pressure when foot pressure is applied against said free end of said lever in said upright position, downwardly arcuately away from said lift stand in said compact mode.

6. The lift stand of claim 1, including stop means to delimit parallelogram-describing movement of said lift stand to an upstanding mode beyond dead center of said lift stand.

7. The lift stand of claim 1, wherein said lift stand comprises four parallel legs, each having an upper end and a lower end, a lift stand base, and a lift stand platform, said lower ends of said legs being pivotally secured to said base, and said upper ends of said legs being pivotally secured to said platform to provide movement describing a parallelogram between said lift stand base and said lift stand platform, whereby said platform is shiftable between substantially compact and substantially upstanding modes of said lift stand, including a stop plate rigidly secured to one of said legs and positioned thereon for arcuate movement into abutting contact with said base when said lift stand is shifted from said substantially compact mode to said substantially upstanding mode.

8. The lift stand of claim 7, including a locking plate rigidly secured to said base and means to interlock said stop plate and said locking plate when said lift stand is in said substantially upstanding mode.

9. The lift stand of claim 8, including a hole in said stop plate, a hole in said locking plate, said holes being concentrically aligned when said lift stand is in said substantially upstanding mode, and pin means insertable in said concentrically aligned holes to prevent relative movement between said stop plate and said locking plate.

10. The lift stand of claim 1, wherein said lift stand comprises four parallel legs, each having an upper end and a lower end, a lift stand base, and a lift stand platform, said lower ends of said legs being pivotally secured to said base, and said upper ends being pivotally secured to said platform to provide movement describing a parallelogram between said lift stand and said lift stand platform, whereby said platform is shiftable between substantially compact and substantially upstanding modes of said lift stand, said platform having an outboard edge when said lift stand is in a substantially compact mode, and wherein said outboard edge and said lift stand base enable said lift stand to be freestanding when said lift stand is rotated from a substantially horizontal compact mode to a substantially vertical compact mode, said base comprising a pair of spaced-apart parallel linear tubular members, said lower ends of said legs being pivotally secured to said tubular members, and said upper ends of said legs being pivotally secured to a pair of parallel side members, said platform, said side members, and said base tubular members providing a stable resting surface when said lift stand is in a substantially vertical compact mode, and including a hand grip secured to the uppermost of said lower cross members when said lift stand is in said substantially vertical compact mode.

11. In a stationary four-legged parallelogram type rectangular motorcycle lift stand having means to raise said lift stand from a substantially horizontal compact mode to a substantially upstanding mode, the improvement comprising: a one-piece foot-operated lever having one free end, and having a cantilevered end pivotally secured to one leg of said four-legged lift stand, said foot lever, when said lift stand is in a compact mode, being pivotal on said lift stand by foot pressure on said cantilevered end from a position folded onto said lift stand to an upright position beyond dead center, substantially normal to said lift stand with said pivoted end in abutting contact with the lower end of said one leg of said four-legged lift stand, wherein foot pressure against said free end of said foot lever, when in upright position, in a direction downwardly arcuate away from said lift stand to a substantially horizontal position, raises said four-legged lift stand from a substantially compact mode to an upstanding beyond dead center mode.

12. The lift stand of claim 11, wherein said pivoted foot lever includes a cantilevered extension portion outboard of the position where said lever is pivotally secured to said lift stand, said cantilevered extension portion providing a surface for foot pressure to pivot said lever from said folded position to said upright position.

13. The lift stand of claim 11, including a foot cleat secured to said cantilevered extension portion of said lever to minimize slippage of foot pressure against said cantilevered extension portion of said lever.

14. The lift stand of claim 11, wherein said lever in said upright position forms an angle with said lift stand of slightly less than 90°.

15. The lift stand of claim 11, wherein said lever in said upright position forms an angle with said lift stand of substantially 84°.

16. The lift stand of claim 11, wherein said free end of said lever includes a foot cleat to minimize slippage of foot pressure when foot pressure is applied against said free end of said lever in said upright position, downwardly arcuate away from said lift stand in said compact mode.

17. The lift stand of claim 11, including stop means to delimit parallelogram-describing movement of said lift stand to an upstanding mode beyond dead center of said lift stand.

18. The lift stand of claim 11, including means to prevent said lift stand from shifting from an upstanding mode beyond dead center to a compact mode.

19. The lift stand of claim 11, wherein said lift stand comprises four parallel legs each having an upper end and a lower end, a lift stand base, and a lift stand platform, said lower ends of said legs being pivotally secured to said base, and said upper ends being pivotally secured to said platform to provide movement describing a parallelogram between said lift stand base and said lift stand platform, whereby said platform is shiftable between substantially compact and upstanding beyond dead center modes of said lift stand.

20. The lift stand of claim 11, including a stop plate rigidly secured to one of said legs and positioned thereon for arcuate movement into abutting contact with said base when said lift stand is shifted from a substantially compact mode to an upstanding beyond dead center mode.

21. The lift stand of claim 20, including a locking plate rigidly secured to said base and means to interlock said stop plate and said locking plate when said lift stand is in an upstanding beyond dead center mode.

22. The lift stand of claim 21, including a hole in said stop plate, a hole in said locking plate, said holes being concentrically aligned when said lift stand is in an upstanding beyond dead center mode, and pin means insertable in said concentrically aligned holes to prevent relative movement between said stop plate and said locking plate.

23. The lift stand of claim 11, wherein said lift stand comprises four parallel legs, each having an upper end and a lower end, a lift stand base, and a lift stand platform, said lower ends of said legs being pivotally secured to said base, and said upper ends being pivotally secured to said platform to provide movement describing a parallelogram between said lift stand base and said lift stand platform, said lift stand base comprising a pair of parallel base members spaced apart to pivotally receive therebetween said lower ends of said four parallel legs, and lower cross members normally extending between said base members to pivotally secure thereon said lower ends of said four parallel legs, said platform being reinforced with opposed side members, and upper cross members normally extending between said opposed side members to pivotally secure thereon said upper ends of said four parallel legs, each of said opposed side members being interposed between said platform and an adjacent base member when in a substantially compact mode, whereby said platform and said base members are sufficiently spaced apart by said side members to stabilize said compact lift stand in a freestanding vertical position.

* * * * *